United States Patent [19]

McDowall

[11] Patent Number: 4,789,046

[45] Date of Patent: Dec. 6, 1988

[54] CEMENT FINISHER'S KNEE BOARD

[75] Inventor: Neil A. McDowall, Moses Lake, Wash.

[73] Assignee: Pro Board, Inc., Moses Lake, Wash.

[21] Appl. No.: 86,374

[22] Filed: Aug. 17, 1987

[51] Int. Cl.[4] ..... E04G 1/00

[52] U.S. Cl. ..... 182/230; 2/24; 5/443; 248/346; 428/314.4; D29/10

[58] Field of Search ..... 248/663, 346; 5/443, 5/434, 436; 2/24; 182/230; 297/423, 438, 439; D29/10; 428/314.4, 314.8, 313.5

[56] References Cited

U.S. PATENT DOCUMENTS

| | | | |
|---|---|---|---|
| 830,103 | 9/1906 | Rundell | 5/443 X |
| 2,448,427 | 8/1948 | Gordon | 297/439 X |
| 2,476,565 | 7/1949 | Russell | 2/24 |
| 2,719,576 | 10/1955 | Emmett | 155/167 |
| 3,112,812 | 12/1963 | Ramon | 182/230 |
| 3,319,273 | 5/1967 | Solin | 5/344 |
| 3,346,877 | 10/1967 | Zirves | 2/24 |
| 3,544,054 | 12/1970 | Ward | 182/230 |
| 4,043,424 | 8/1977 | Crain | 182/230 |
| 4,346,784 | 8/1982 | Hammond | 182/230 |
| 4,423,694 | 1/1984 | Senneville | 428/314.4 |
| 4,673,216 | 6/1987 | Alfer | 5/443 X |

OTHER PUBLICATIONS

Dow Chemical Company: "Styrofoam Brand Insulation Products For Walls, Foundations and Roofs, 07200/DOt, Buyline 2930".

Dow Chemical Company: "If You Need It . . . We've Got It".

"Cut Foundation Heat Loss For Comfort-Dow Chemical Company: Able Salabe Homes-Install StyrofoamTG".

Dow Chemical Company: "If You Need It . . . We've Got It".

"Cut Foundation Heat Loss For Comfort-Dow Chemical Company: Able Salable Homes-Install Styrofoam TG".

*Primary Examiner*—Ramon S. Britts
*Assistant Examiner*—David L. Talbott
*Attorney, Agent, or Firm*—Dowrey, Cross & Cole

[57] ABSTRACT

A rigid light weight knee board for cement finishers. The body of the knee board comprises a high density extruded closed cell polystyrene foam. A water repellent cover made from soft pliable vinyl is provided for the board and includes an upright handle strap.

10 Claims, 1 Drawing Sheet

FIG. 4

FIG. 1
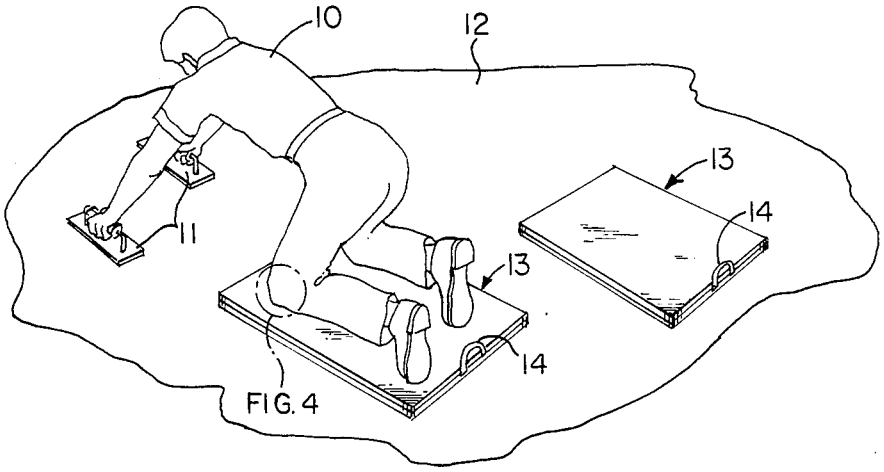
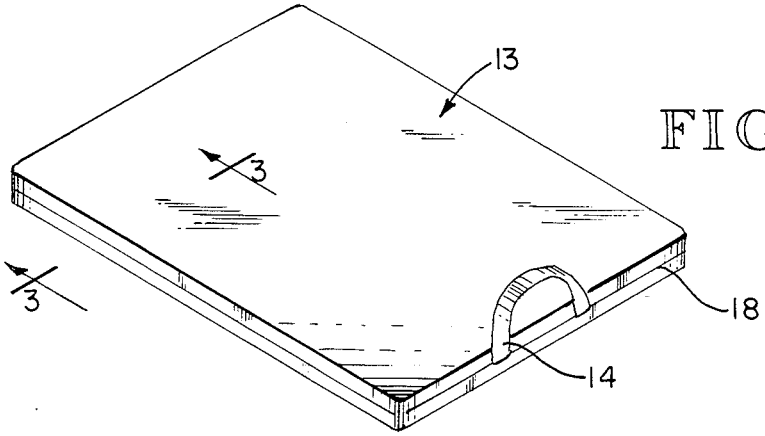
FIG. 2
FIG. 3
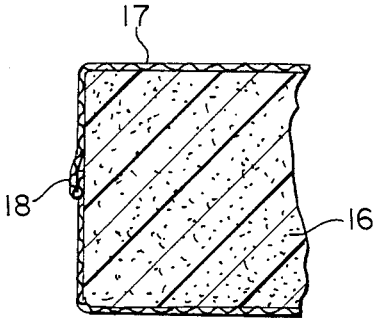
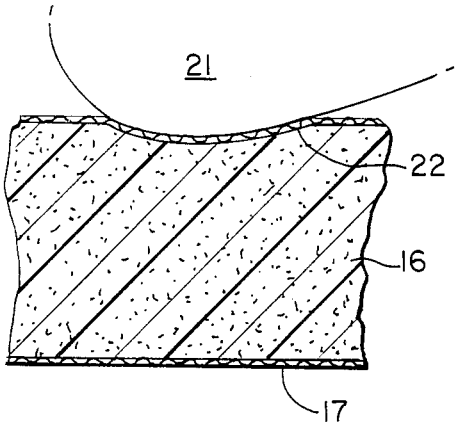
FIG. 4
FIG. 5
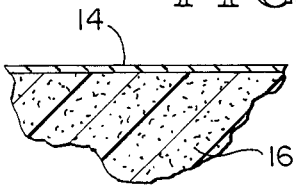

CEMENT FINISHER'S KNEE BOARD

BACKGROUND OF THE INVENTION

1. Field of the Invention

This invention relates to supports for workmen who must perform their work in a constant kneeling position. The support must perform the functions of (1) protecting the knees of the user over a sustained period of use (2) distribute the workman's weight over an increased area and (3) serve to protect or guard the surface being worked. More particularly, the present invention relates to a knee board or kneeling board especially adapted for use in finishing cement or concrete floors and slabs. The work of smoothing and finishing the surface of a concrete slab is, of course, done prior to hardening of the cement and while the cement is still green and wet or moist on the surface. This invention is directed to a single board which accommodates both knees and both toes allowing the workman to work with finishing trowels in a full kneeling position without the necessity of strap-on devices for the knees or legs.

2. Description of the Prior Art

In the construction industry, concrete slabs are commonly finished by hand troweling. The work is usually done by assuming a full kneeling position and using one or two hand trowels as the workman moves rearwardly across the surface of the uncured cement surface. Working under these conditions requires some form of protection for the workman's knees both in terms of flotation or support on the surface of the soft concrete and from the standpoint of cushioning or easing the pressure on the workman's knees over sustained periods of time. In addition, the support apparatus must also be such as to avoid as much damage as possible to the soft surface of the uncured cement. Since the workman must traverse the slab, whatever knee protection and support is utilized must also move with the workman across the soft surface. One common form of protection for floor finisher's knees which has been used in the past, with many attendant problems, are devices which fasten to the user's knees or legs with straps, belts or the like which hold the knee pad to the leg in the kneeling position. The Russell U.S. Pat. No. 2,476,565, issued July 19, 1949 and the Zirves U.S. Pat. No. 3,346,877 are examples of such types of knee or leg engaging pads. Th patent to Zirves, although not directed specifically to cement finishing, illustrates a typical clip-on knee pad. The devices of both of these patents are necessarily flexible so as to be worn or wrapped around the knee and thus do not function in a satisfactory manner to support the workman on a soft surface such as wet concrete. Soft pliable knee pads of this type are thus not generally acceptable for cement finishing. In addition, this type of knee pad does not make provision for supporting the use's toes while in a kneeling position which is a problem on a wet soft surface. Attempts have been made to combine the soft cushion type knee protectors such as discussed above with hard surface flotation boards which accommodate both the knee and the toe of each individual leg of the user. Examples of this type of strap-on knee protectors are illustrated in the to Emmett U.S. Pat. No. 2,719,576, issued Oct. 4, 1955 and the Ramon U.S. Pat. No. 3,084,458, issued Apr. 9, 1963. These two types of devices are similar in that a soft or pliable resilient cushion member is mounted on the top of a hard surface flotation board. The board is usually formed from wood or other hard smooth surface material. These two later patents have the same drawbacks as previously described in that the use of straps which engage the knee or the calf of the leg become extremely uncomfortable over long periods of time when in the kneeling position. These devices are also extremely cumbersome when considering that a separate device is utilized for each leg an must be dragged across the soft wet surface as the finisher moves backwardly. A further example of the individual kneeling board is disclosed in the Hammond U.S. Pat. No. 4,346,784, issued Aug. 31, 1982. This type of individual knee and toe board also combines a hard surface wooden board or the like with a cushion surface on the upper side. Although the prior art contains examples of knee pads and floor mats in general such as the Rundell U.S. Pat. No. 830,103, issued Sept. 4, 1906 and the Solin U.S. Pat. No. 3,319,273 issued May 16, 1967, such soft and pliable pads do not offer a solution to the problems inherent to knee protection and soft surface cement finishing of the type under consideration.

As a result of the difficulties and inadequacies of prior art support devices and knee protectors available to the cement finisher, it is still by far the most common practice to simply utilize a piece of plywood, oftentimes with no knee padding or protection whatsoever to ease the pressure on the workman's knees. The presence of straps or buckles about the knee and calf when used have the effect of limiting blood circulation over long periods of kneeling. Usually two such plywood boards are utilized with the workman moving from one board backwardly to another, moving the previously used board to a new position and thus incrementally moving across the wet concrete surface from one board to the other. This common practice results in severe knee injury when practiced over an extended number of years. The result is a very slow and progressive disabling of the user's knees and attendant pain and discomfort. In addition, this process of hard board placement and movement across the soft concrete surface entails additional work for the craftsman since each time the board is moved, dragged or lifted off of the uncured cement surface a considerable amount of cleanup of that area must take place. This is augmented by the fact that the wood surface absorbs moisture and the concrete adheres to it. The present practice of hard knee board use with all of its problems is evidence of the inadequacies or the undesirabilities of known protection devices.

SUMMARY OF THE INVENTION

The present invention provides a novel knee board particularly adapted for cement finishers which overcomes the difficulties and drawbacks experienced with prior art devices. The present invention eliminates any need for knee straps, toe straps and/or independent apparatus for separately attaching to and moving with each leg of the workman. The knee board of the present invention combines the functions of weight spreading, support or flotation and knee protection which in the past has required separate hard boards and soft cushion elements. The present invention utilizes a single member which is extremely stiff and is not bendable so as to be capable of spreading the weight of the user over a significant area and at the same time provide the requisite deformation and cushioning at the knee contacting surface to protect the user's knees from injury. The knee board of the present invention is extremely buoyant and may be conveniently moved about on the wet concrete surface without damage to the board or to the concrete surface and with very little physical effort required. In this sense, the present invention provides extreme advantages over the present practice of using relatively heavy plywood knee boards which tend to sink into the concrete and scar the soft cement surface and which are cumbersome to move from one spot to another. The cleanup required subsequent to moving one of the knee boards of the present invention is also extremely slight compared to the damage done by either hard support boards or soft pliable knee pads of the prior art patents discussed. The combination of rigidity, high degree of buoyancy, and inherent cushioning qualities along with moisture resistance and the moisture proofing by use of a soft pliable skin or covering for the knee board renders the apparatus of the presnet invention usable and practical as opposed to the complicated devices known in the prior art. The knee board and soft pliable plastic cover of the present invention may be simply washed or hosed off following use without damage to the board. The soft pliable skin or cover also eliminates any tendency for sharp edges or corners of the board from marring the soft moist cement surface. An upstanding strap or handle is utilized to facilitate movement of the lightweight pads from one position to the other as the finisher completes the immediate area and moves backwardly.

The present invention accomplishes the advantages described by the use of a high density rigid closed cell foam plastic material with sufficient compressive strength to support and spread the weight of the individual without cracking or breaking or losing its dimensional stability. The material is visco-elastic in that the surface yields steadily until a constant stress level is reached. This surface yielding or deformation along with partial return provides excellent protection to the knees of the user and eliminates the need for additional knee pads allowing the workman to stay on the surface longer. Because of the excellent flotation quality of the buoyant foam plastic material it is possible to get on the wet surface sooner than with conventional heavy hard boards which need a firmer surface for support. All of these advantages are gained with an extremely simplified structure and the utilization of extremely inexpensive materials.

BRIEF DESCRIPTION OF THE DRAWINGS

FIG. 1 is a perspective view of the typical use of the knee board of the present invention by a workman during troweling of a soft cement work area;

FIG. 2 is a perspective view of the knee board of the present invention;

FIG. 3 is a cross-sectional detail taken along lines 3—3 of FIG. 2 illustrating the board member and the protective pliable covering and seam;

FIG. 4 is a sectional detail illustrating the yielding and deformation of the board surface and protective covering during use; and FIG. 5 illustrates an alternative means for applying a waterproof and surface protection layer to the knee board body.

DESCRIPTION OF THE PREFERRED EMBODIMENT

FIG. 1 illustrates the use of the present knee board wherein the workman 10 may be in a full kneeling position, i.e. with both knees and both toes on the board. One or two trowels 11 are used to finish and smooth the fresh cement surface 12. The cement surface is generally soft and moist during the time of finishing. As illustrated, two knee boards 13 of the present invention are utilized in such a manner that when the workman 10 finishes the immediate area in front and about the board 13 in use, he moves rearwardly onto the second knee board 13 and moves the first knee board into a rearward position so that he may progress incrementally across the surface of a floor or slab. Each board 13 is provided with a handle or upstanding strap 14 to facilitate lifting and moving the board.

Referring to FIGS. 2 and 3, the knee board comprises a rigid high density cellular foam plastic body 16 which is preferably $1\frac{1}{2}$ to 2 inches in thickness and having overall length and width dimensions of approximately 18–24 inches. The dimensional area covered by the board 13 may, of course, be varied but should be sufficient to permit a workman to comfortably rest both knees and both toes on the board during its use. As aforementioned, the expanded foam plastic body 16 of the board is sufficiently rigid to support and spread the weight of a workman without breaking or deflecting to any appreciable extent. The high density foam plastic 16 is covered with a waterproof jacket 17 which may be seamed around the vertical edges as at 18 to provide a watertight seal. The waterproof or water resistant covering 17 may be made from a variety of pliable plastic materials such as vinyls and the like. The covering 17 illustrated is a fabric backed vinyl sheet which may be sewn at the seams 18. The handle or strap 14, as shown in FIG. 2, may be sewn into the seam or may be otherwise securely attached to the vinyl jacket. The vinyl or other plastic material covering serves not only to further waterproof the expanded foam but provides the rigid board with soft corners and edges so as to reduce or eliminate any tendency of the board to scar the surface of the moist concrete. Because of the lightweight and buoyant characteristic of the foam plastic, however, any tendency to scar the surface is greatly diminished as compared to heavy hard boards such as plywood utilized in the prior art. The plastic jacket provides durability to the expanded foam body and actually protects the foam from being damaged by contact with tools such as the hand trowels being wielded by the workman. While the present embodiment of the invention as illustrated in FIGS. 1–4 utilizes a seamed vinyl covering, it will be apparent that other durable plastic coverings could be utilized and seaming could be done by other methods such as heat sealing etc. FIG. 5 illustrates another alternative for covering cellular plastic foam by means of simply coating the board 16 with a compatible plastic by such methods as dipping or otherwise applying the protective layer.

FIG. 4 illustrates the characteristic of the cellular foam plastic wherein the user's knee 21 initially causes a depression or indentation 22 in the top surface of the knee board. The visco-elastic characteristics of the board surface result in the yielding of the surface to a point where the stress on the material becomes constant and the material is stabilized. While some degree of return will be experienced with the board surface, the cushioning effect of the material on the user's knee remains throughout use of the board.

The expanded foam material 16 is comprised of an extruded closed cell polystyrene foam. This material is a high density rigid cellular foam plastic developed around 1945 and is available and sold under the name STYROFOAM, a trademark of Dow Chemical Company. The product is commercially available and commonly used as heat insulation material and is described in the Dow Chemical Company product specification publication *Sytrofoam Brand Insulation Products for Walls, Foundations and Roofs,* 07200/DOT, Buyline 2930. The material is foamed or expanded by an extrusion process as contrasted to the typical molded bead polystyrene foam. The extruded closed cell material is a high density rigid material with no voids between the cells. This closed cell structure results in a material which may range from 2–3 pounds per cubic foot. The voidless closed cell structure also results in a highly moisture resistant material, which adds to its desirability for use in conjunction with a wet surface environment. The relatively light weight material provides a highly buoyant board which tends to float better than hard board such as plywood, metal or the like. The compressive strength of the extruded closed cell polystyrene foam is expressed in terms of the vertical compressive loading at which the surface will yield and deform. The compressive strength of the extruded closed cell polystyrene foam may range typically from a low of 25 psi (pounds per square inch) to a high of 70 psi.

The preferred extruded high density closed cell polystyrene foam which provides excellent results is in a range of 1–2 inches in thickness and weighing from 2–3 pounds per cubic foot of material. The preferable range of compressive strength is from 25–45 psi.

Excellent results have been obtained using a 1½ inch extruded closed cell polystyrene foam having a weight of 2–2.5 pounds per cubic foot and a compression strength of 40 psi.

The knee board of the present invention provides the essential characteristics of known prior art knee boards or knee pads by providing an improved structure which combines the rigidity necessary for flotation and weight spreading on a soft wet surface yet cushions and protects the user's knees. The foam plastic is protected form physical damage and abuse with a durable and soft pliable plastic cover which also provides moisture proofing for easy cleanup. This combined function is an improvement over the prior art wherein two elements, namely a hard board and a separate cushion is necessary. In addition, the buoyancy obtained by the light weight foam material and the use of a soft pliable cover significantly reduces damage to the wet concrete surface as compared with prior art hard boards.

Although the present invention has been disclosed and described with relation to specific embodiments, it will be apparent to those skilled in the art that modifications may be made without departing from the spirit of the invention or from the scope of appended claims.

What is claimed is:

1. A cement finisher's knee board comprising;

a rigid high density body member comprising extruded closed cell polystyrene foam having a thickness of from 1–2 inches and a weight of from 2–3 pounds per cubic foot, said body member having at least one flat surface adapted to be supported from a wet cement surface and the opposite surface thereof adapted to accommodate a kneeling workman, said surfaces being visco-elastic and having a vertical compression load capacity of from 25–45 psi, and a soft pliable water repellant cover layer surrounding said foam body member.

2. The knee board according to claim 1 wherein said cover layer is composed of vinyl plastic and includes carrying strap means connected thereto; said strap means extending above said opposite surface.

3. The knee board according to claim 1 wherein said body member is 1½ inches thick having a weight of 2–2.5 pounds per cubic foot and a vertical compression load capacity of 40 psi.

4. A cement finisher's knee board comprising;

a rigid body member comprised of high density polystyrene foam weighing 2–3 pounds per cubic foot and having a thickness of 1½ to 2 inches, said body member including first and second opposed flat surfaces adapted to be supported from a wet cement surface and to accommodate a kneeling workman respectively;

said surfaes being visco-elastic and having a vertical compression load capacity of 25–45 psi, and a soft pliable water repellant cover surrounding said foam body.

5. The knee board according to claim 4 wherein said cover layer is composed of vinyl plastic and includes carrying strap means connected thereto; said strap extending above said second flat surface.

6. The knee board according to claim 4 wherein said body member is 1½ inches thick having a weight of 2–2.5 pounds per cubic foot and a vertical compression load capacity of 40 psi.

7. A cement finisher's knee board for supporting a person in a kneeling position on a wet uncured cement surface comprising;

a rigid expanded foam body having flat top and bottom surfaces of sufficient dimensions to accommodate both knees and both toes of a person in a kneeling position, a soft pliable water repellant cover layer surrounding said foam body, and carrying strap means connected to said cover, said foam body being comprised of extruded high density closed cell plastic foam, being approximately 1–2 inches in thickness and having a weight of 2–3 pounds per cubic foot, said foam body being visco-elastic and having a vertical compression load capacity of 25–45 psi, whereby cushioning is provided for the knees of the person while the body weight of the person is distributed over the area covered by the knee board with no substantial deflection of the board body.

8. The knee board according to claim 7 wherein said cover layer is composed of vinyl plastic and said carrying strap means is connected to said vinyl plastic cover.

9. The knee board according to claim 8 wherein said closed cell plastic foam comprises polystyrene.

10. The knee board according to claim 9 wherein said closed cell foam body is 1½ inches thick having a weight of 2–2.5 pounds per cubic foot with a vertical compression load capacity of 40 psi.

* * * * *